US007397927B2

(12) United States Patent
Pircaro et al.

(10) Patent No.: US 7,397,927 B2
(45) Date of Patent: Jul. 8, 2008

(54) LOUDSPEAKER SUSPENSION

(75) Inventors: Mark A. Pircaro, Yuma, AZ (US); Subarna Basnet, Natick, MA (US); Mark P. Temple, Bolton, MA (US)

(73) Assignee: Bose Corporation, Framingham, MA (US)

( * ) Notice: Subject to any disclaimer, the term of this patent is extended or adjusted under 35 U.S.C. 154(b) by 226 days.

(21) Appl. No.: 10/993,996

(22) Filed: Nov. 19, 2004

(65) Prior Publication Data

US 2006/0110002 A1 May 25, 2006

(51) Int. Cl.
*H04R 7/18* (2006.01)

(52) U.S. Cl. ..... 381/398; 181/172

(58) Field of Classification Search ..... 381/398, 381/403, 392, 423, 424; 181/171, 172, 173, 181/174

See application file for complete search history.

(56) References Cited

U.S. PATENT DOCUMENTS

| | | | | |
|---|---|---|---|---|
| 1,734,624 | A | 11/1929 | Harrison | |
| 1,891,566 | A | 12/1932 | McKellip | |
| 2,302,178 | A | 11/1942 | Brennan | |
| 2,439,665 | A | 4/1948 | Marquis | |
| 3,563,337 | A | 2/1971 | Yokohama | |
| 3,997,023 | A | 12/1976 | White | |
| 4,321,434 | A * | 3/1982 | Irie | 181/173 |
| 4,324,312 | A | 4/1982 | Durbin | |
| 4,433,214 | A * | 2/1984 | Jasinski | 381/398 |
| 4,881,617 | A | 11/1989 | Faraone | |
| 5,371,805 | A * | 12/1994 | Saiki et al. | 381/398 |
| 5,903,656 | A * | 5/1999 | D'Hoogh et al. | 381/333 |
| 6,305,491 | B2 * | 10/2001 | Iwasa et al. | 181/172 |
| 6,449,375 | B1 * | 9/2002 | Hutt | 381/403 |
| 6,567,528 | B1 * | 5/2003 | Heed | 381/404 |
| 6,697,496 | B2 * | 2/2004 | Frasl | 381/398 |
| 6,725,967 | B2 * | 4/2004 | Hlibowicki | 181/172 |
| 6,851,513 | B2 * | 2/2005 | Stead et al. | 181/172 |
| 7,054,459 | B2 * | 5/2006 | Kuze et al. | 381/398 |
| 2002/0144859 | A1 | 10/2002 | Pocock et al. | |
| 2002/0170773 | A1 | 11/2002 | Stead et al. | |
| 2003/0070869 | A1 | 4/2003 | Hlibowicki | |
| 2003/0231784 | A1 | 12/2003 | Kuze et al. | |

FOREIGN PATENT DOCUMENTS

| | | |
|---|---|---|
| EP | 1 381 251 | 1/2004 |

(Continued)

OTHER PUBLICATIONS

Audio Engineering Handbook, p. 7.32, Copyright 1988 by McGraw-Hill, Inc.

(Continued)

*Primary Examiner*—Brian Ensey
(74) *Attorney, Agent, or Firm*—Fish & Richardson P.C.

(57) ABSTRACT

A loudspeaker suspension structure has an inner circumferential border, and an outer circumferential border, and grooves each extending from the inner circumferential border to the outer circumferential border at an angle with respect to a normal to the inner circumferential border, a profile of a circumferential section of the suspension structure having continuous curvature. Each of the grooves varies from the inner border to the outer border, the variation corresponding to a variation of a principal contour of the suspension structure.

44 Claims, 13 Drawing Sheets

FOREIGN PATENT DOCUMENTS

| | | | |
|---|---|---|---|
| GB | 726 780 | | 3/1955 |
| GB | 1 478 371 | | 6/1977 |
| JP | 58127499 | | 7/1983 |
| JP | 59050698 | A | 3/1984 |
| JP | 60027299 | A | 2/1985 |
| JP | 6126499 | A | 12/1986 |

OTHER PUBLICATIONS

Fostex NF-7 Technical White Paper, Sep. 1998.
Sony MHC-RX88, What HI-FI?, p. 103, Published Sep. 23, 1998.
Audio Engineering Handbook, p. 7.32, Copyright 1998 by McGraw-Hill, Inc.
Hasegawa, et al., SAE Technical Paper Series—850162, 3-D Loud-Speaker Systems for Automotive Use, International Congress & Exposition, Detroit, Michigan, Feb. 25-Mar. 1, 1985.
Better Listening Through Chemistry, Yamaha Advertisement, Yamaha Electronics Corporation, USA, P.O. Box 6660, Buena Park, CA 90622, Stereo Review, Oct. 1982.
How to Reap the Rewards of Higher Fidelity, Altec Advertisement, Altec Lansing Consumer Products, Milford, PA, Audio Video International, June 1986.
Pyramid Product Catalog, 2002, p. 38.
Kicker CompVR Woofer Technical Manual, Version 2.1, Apr. 23, 2002, pp. 2-34, p. 4.
Toplone Speakers Catalogue, Specification of Part No. F52A32-1, p.7, Tokyo Cone Paper Mfg. Co., Ltd. 87 Niigatafukuro Kasukabe-City Saitama-Pref, 344-0056, Japan.
http://www.lautsprechershop.de/hifi/visation_mt.htm, Visation Chassis, DSM50FFL, downloaded Apr. 11, 2007.
AudioVideo International, Jan. 1999, Pioneer Elite TZF700 Speaker System, CES 1999, p. 124.
Bravox uxs8 woofer, (downloaded May 23, 2007) http://www.bravoxaudio.com/uxs.asp.
Visaton DSM 50 FFL 8 OHM, (downloaded May 23, 2007) http://www.visaton.com/en/chassis_zubehoer/mt_kalotten/dsm50ffl_8.html.
Stretron Low Profile Speaker, (downloaded May 23, 2007) http://www.stetron.com/speakers/pdf/Low%20Profile%20Speakers.pdf.
Hygeia FT2591, (downloaded May 23, 2007) http://www. hg-audio.com.tw/en_products.html.
18 Sound Model 6ND430, (downloaded May 23, 2007) http://www.eighteensound.it/index.aspx?mainMenu=view_product&pid=243.
Foster Models 334495, 334459, 056117, 334496, 060588, (downloaded May 23, 2007) http://www.foster.co.ip/en_products/microspeakers/index.html.

* cited by examiner

LOUDSPEAKER SUSPENSION

BACKGROUND

This invention relates to loudspeaker suspensions, including surrounds and spiders.

Referring to FIG. 1, a typical loudspeaker 14 includes a stiff cone 15 connected to a voice coil 20 at the apex of the cone. The loudspeaker can include a dust cap 23 attached to the cone. The voice coil 20 interacts with the magnetic circuit formed from permanent magnet 25, back plate/pole piece structure 30, and top plate 21. When the voice coil is driven by an audio signal, the cone vibrates axially to produce sound.

An outer edge 40 of the cone is attached to a rigid basket 45 along an annular mounting flange 47 by suspension element 50, typically referred to as a surround. The voice coil 20 and/or apex of cone 15 may be attached to another section of the rigid basket 45 by second suspension element 35, typically referred to as a spider. The surround 50 is often made from a flexible material such as fabric, that allows the cone to vibrate but provides a restoring force to aide in returning the cone to an at-rest position, when the voice coil 20 is not being driven. The spider 35 typically is a circular woven cloth part with concentric corrugations. The suspension elements provide a restoring force (along the axial direction) and a centering force (along the radial direction) for the moving assembly. Single or multiple surrounds and/or spiders may be used in various transducer embodiments.

Referring now to FIGS. 2A and 3, prior art surround 50 can be seen to be a hollow semi-toroid about a center O with an inner circumferential edge 60 and an outer circumferential edge 55.

As shown in FIG. 4, surround 50 is depicted as having a semicircular or dome shaped cross-section taken along line A-A of FIG. 2A.

FIG. 3 shows a plan view of an alternative prior art surround configuration. FIG. 5 shows a circumferential section along line B-B of FIG. 3. The example surround in FIG. 3 has grooves 65 extending outward at an angle to the radial direction, over the majority of the span from the inner to the outer circumferential edges of the surround. Each groove has a V-shaped trough D at the bottom and folded corners E, F at the top.

SUMMARY

In general, in one aspect, the invention features an apparatus that includes: a loudspeaker suspension structure having an inner circumferential border, and an outer circumferential border, and grooves each extending from the inner circumferential border to the outer circumferential border at an angle with respect to a normal to the inner circumferential border, a profile of a circumferential section of the suspension structure having continuous curvature.

Implementations may include one or more of the following features. The groove spans only a portion of the distance between the inner circumferential border and the outer circumferential border. The continuous curvature is cyclical. The continuous curvature includes a series of peaks and grooves and the radius of curvature of each of the peaks is greater than the radiuses of curvature of the adjacent grooves. The continuous curvature includes a series of peaks and grooves and the radius of curvature of at least a portion of each of the peaks is less than (or in other examples greater than) the radiuses of curvature of the adjacent grooves. The ratio of the radius of curvature of each of the peaks to the radiuses of curvature of the adjacent grooves is less than 3 (or less than 5 or less than 10). The suspension structure comprises a fractional part of a toroid. The suspension structure conforms to a rolled shape. The rolled shape is rolled up. The rolled shape is rolled down. The rolled shape comprises two or more rolls between the inner circumferential border and the outer circumferential border. A radius of curvature of each of the grooves is at least about three times a thickness of a material of which the suspension structure is formed. A radius of curvature of each of the grooves is at least about seven times a thickness of a material of which the suspension structure is formed. Grooves are spaced regularly along a circumference of the suspension structure, each of the grooves has a depth, and a pitch of the spacing is at least about four times the depth. The grooves are straight in plan view. The angle of the straight grooves is in the range of 10 to 80 degrees. Each of the grooves comprises a curve in plan view. The angle of the curved grooves is in the range of 0 to 80 degrees. The curve begins at an angle to the normal to the inner circumferential border or the outer circumferential border. The curve comprises sections. The sections comprise straight sections or curved sections. The sections have respectively different angles with respect to the normal to the inner border. The sections also comprise transition sections that smoothly the straight or curved sections. The sections meet at inflection points. Each of the grooves has a depth that varies from the inner border to the outer border. The variation corresponds to the variation in height of a principal contour of the suspension structure. The groove has a larger radius of curvature than does the principal contour. Each of the grooves has a generally constant depth along most of a path of the groove. The groove includes two or more local minima or maxima. A radial cross section of the suspension structure has a configuration of a partial toroid. A radial cross section of the suspension structure has a configuration other than of a partial toroid. A radial cross section of the suspension structure has two or more local minima or maxima. The continuous curvature comprises a piecewise linear contour. The suspension structure comprises a surround. The suspension structure comprises a spider.

In general, in another aspect, the invention features an apparatus comprising a loudspeaker suspension structure having an inner circumferential border, and an outer circumferential border, and grooves each extending from the inner circumferential border to the outer circumferential border at an angle with respect to a normal to the inner circumferential border, the bottom of each of the grooves varying from the inner border the outer border, the variation corresponding to a variation of a principal contour of the suspension structure.

In general, in another aspect, the invention features an apparatus comprising: a loudspeaker suspension structure having an inner border, an outer border and a material thickness; grooves extending from the inner border to the outer border and separated by a groove pitch, the grooves having a groove radius of curvature; and peaks defined between the adjacent grooves and having a peak radius of curvature less than about ten times the groove radius.

Implementations of the invention may include one or more of the following features. The peak radius is less than about five times the groove radius. The peak radius is less than about three times the groove radius. The grooves are curved in plan view. The grooves are straight in plan view.

In general, in another aspect, the invention features a loudspeaker comprising: a cone; a basket to support the cone; a surround having a partially toroidal contour, an inner circumferential border, and an outer circumferential border, the surround being formed of a material having a thickness; the surround flexibly connecting an outer border of the cone to the basket; peaks having an axial height and extending from the inner circumferential border to the outer circumferential border and separated by a peak pitch, the peaks defining a peak radius of curvature; and grooves extending between the adjacent peaks, the grooves defining a groove radius of curvature, the groove radius being at least about three times the material thickness.

Other advantages and features will become apparent from the following description and from the claims.

DESCRIPTION

Figure 12:
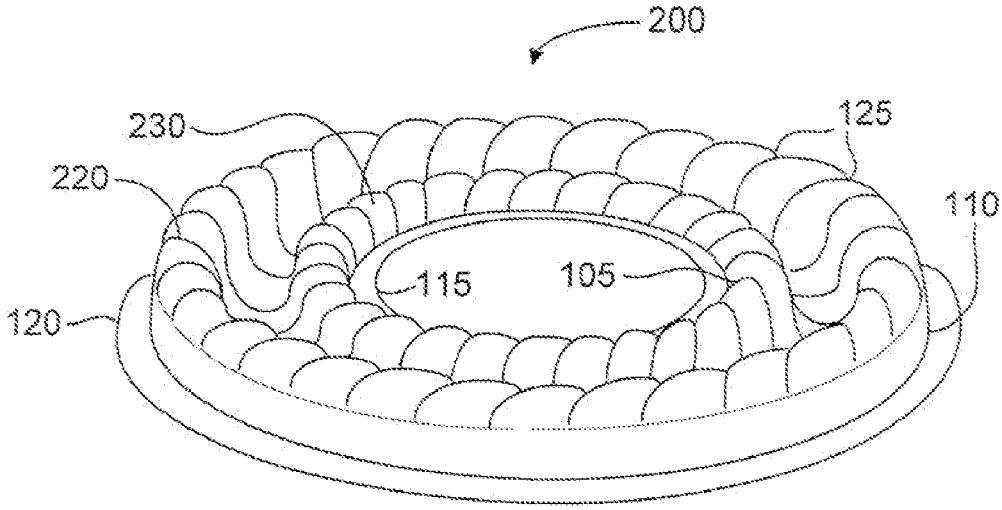
FIG. 12 is a perspective view of a loudspeaker spider suspension element.

(In the following discussion, description of the behavior of a surround suspension element is provided, but the discussion can be generalized to include other suspension elements, such as spiders. An embodiment depicting a spider is shown in FIG. 12.)

Figure 6A:
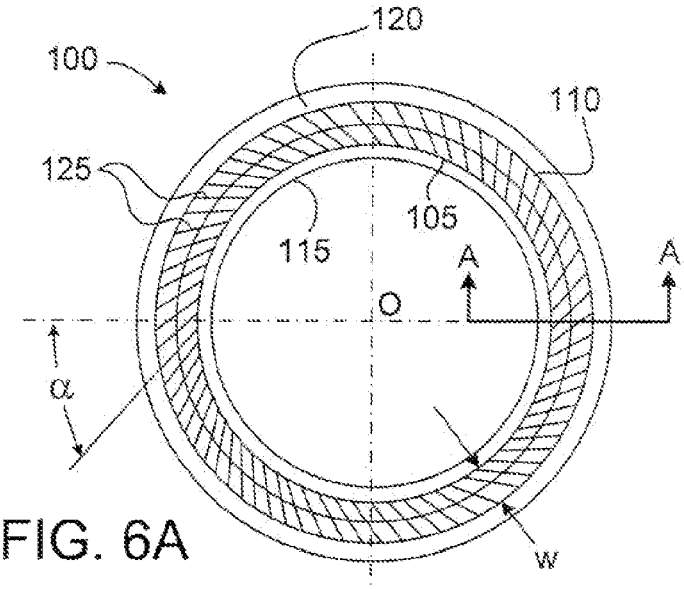
FIG. 6A is a plan view of a loudspeaker surround suspension element.
Figure 6B:
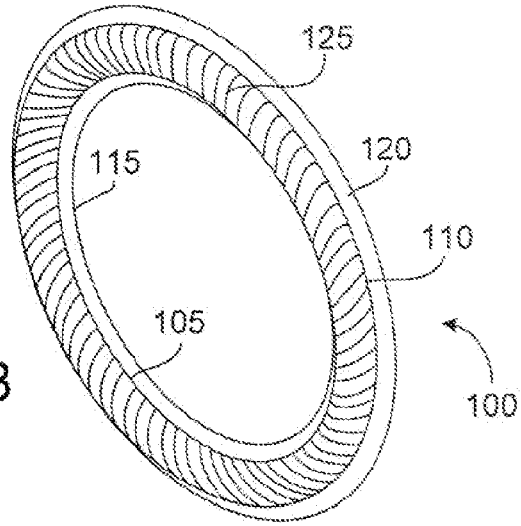
FIG. 6B is a perspective view of the surround suspension element of FIG. 6A.
Figure 6C:
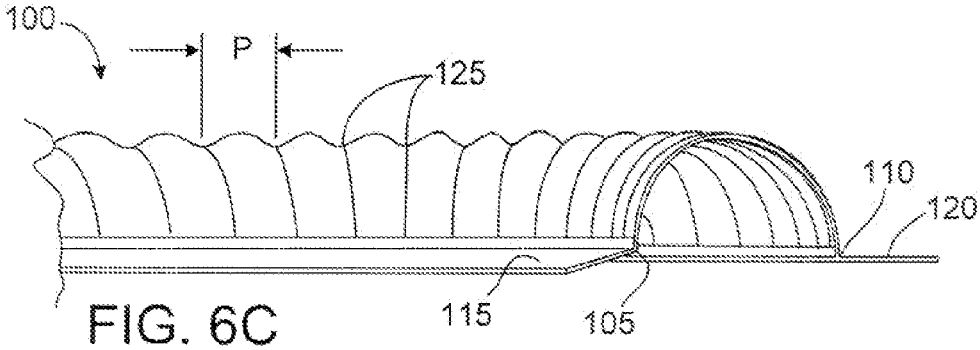
FIG. 6C is a perspective cross-sectional view taken along line A-A of FIG. 6A.

Referring to FIGS. 6A to 6C, a semi-toroidal surround suspension element 100 is centered about an origin O and includes an inner circumferential edge 105 and an outer circumferential edge 110, separated by a radial width or span W. The surround 100 can include an inner attachment flange 115 extending radially inward from the inner circumferential edge 105 and an outer attachment flange 120 extending radially outward from the outer circumferential edge 110 for connection to the cone and basket, respectively. As used herein, the surround 100 can also include a loudspeaker spider, an example of which is shown in FIG. 12. Surround 100 in FIGS. 6A-6C is shown having a single convolution (in the form of a half roll up spanning the width W), but other surround embodiments may have multiple convolutions. A convolution as the term is used herein, comprises one cycle of a possibly repeating structure, where the structure is typically comprised of concatenated sections of arcs. The arcs are generally circular, but can have any curvature. Spider 200 in FIG. 12 includes multiple (two in this case) convolutions 220, 230. In other spider embodiments, more or fewer convolutions, or portions of convolutions, may be used.

Figure 8:
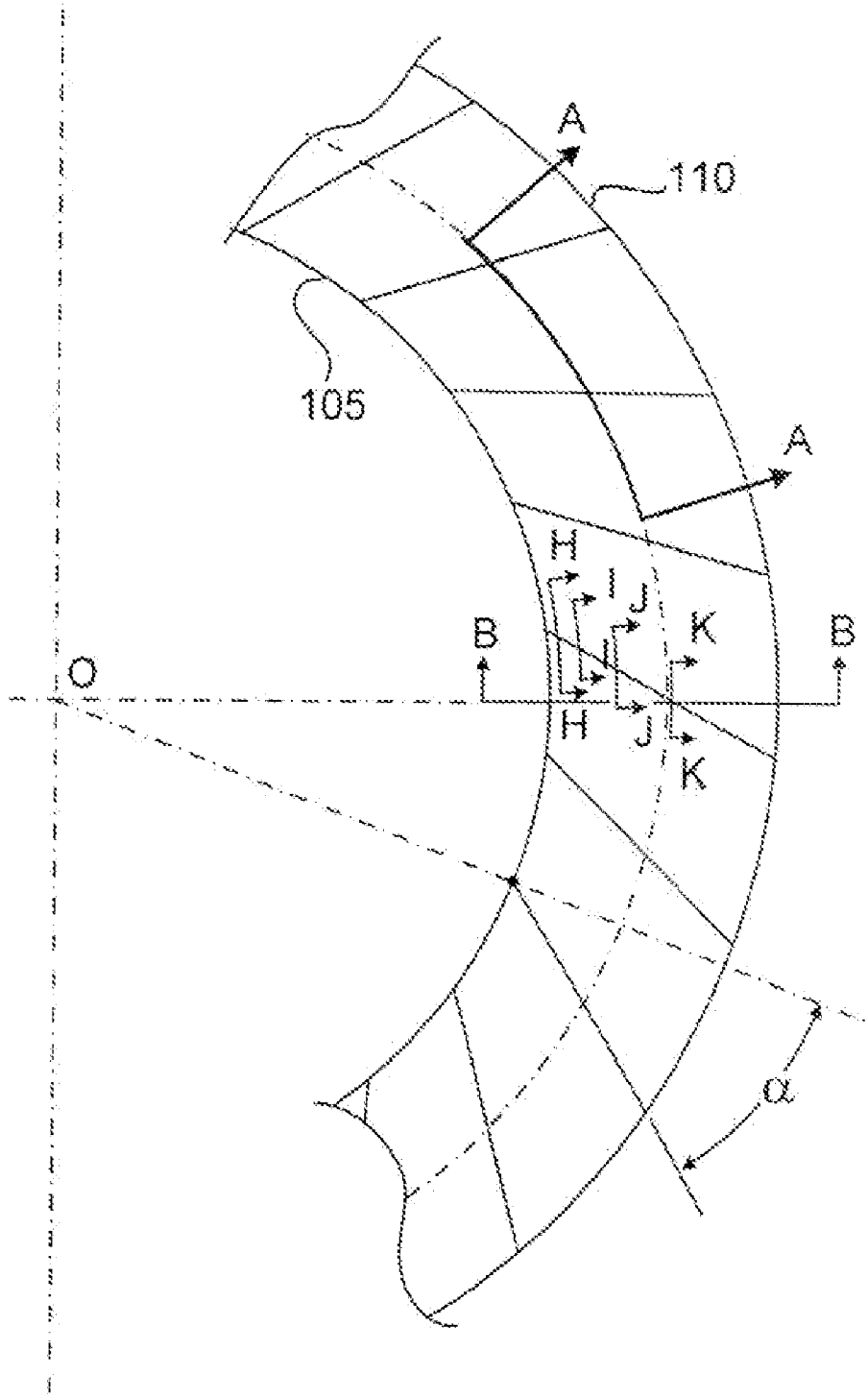
FIG. 8 is a partial schematic plan view of a loudspeaker surround suspension element.
Figure 9A:
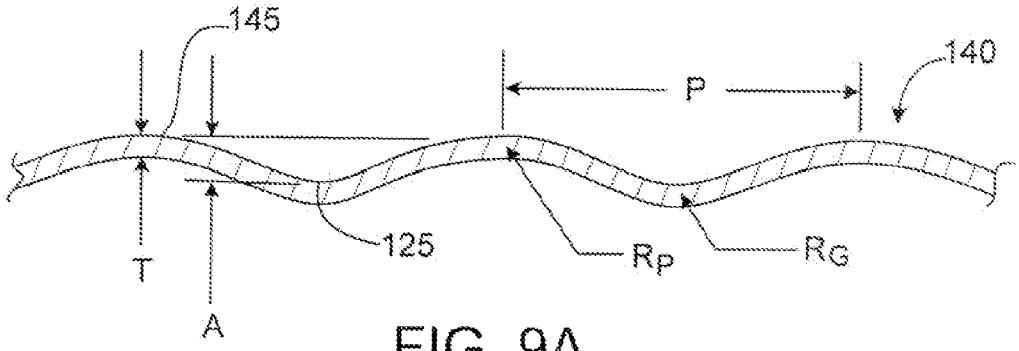
FIG. 9A is a circumferential profile of a loudspeaker surround suspension element taken along line A-A of FIG. 8.

Although surround 100 in FIGS. 6A-6C is depicted as a partial toroidal section, other less axially symmetrical shapes for attachment to non-circular cones (e.g. elliptical, racetrack, or other non-circular shapes) are contemplated. In places where a circumferential cross section is mentioned, it should be understood that we also mean to encompasses non-circular geometries. A circumferential section A-A of FIG. 8 is shown in FIG. 9A. This section is taken at a constant normal distance to the inner edge of the surround suspension element. For a surround with a circular geometry, this section will trace out a circle. A similar section for a surround with a non circular geometry is also understood to be taken at a constant normal distance from the inner edge, but the path traced around the surround for such embodiments would no longer be circular. For ease of description, we mean the term circumferential section to encompass cases of both circular and non circular surround geometries, where the section is taken at a constant normal distance from the inner suspension element edge.

Figure 9B:
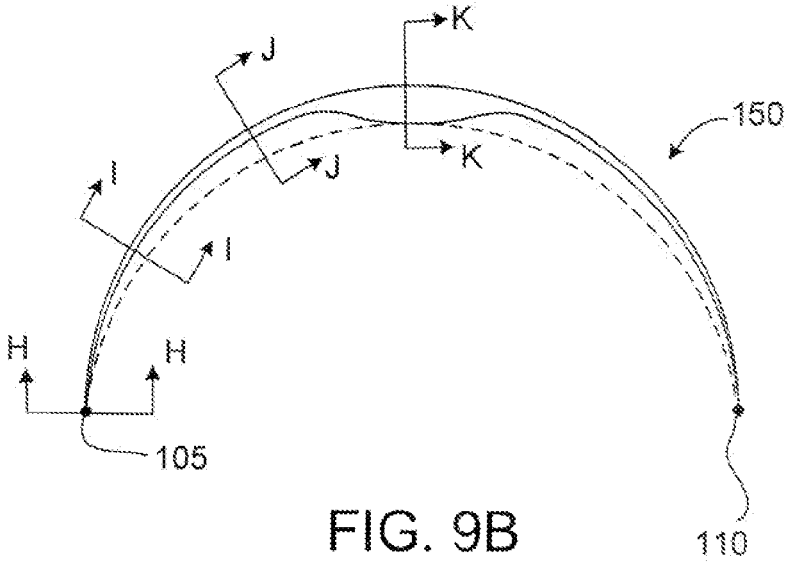
FIG. 9B is a radial profile of a loudspeaker surround suspension element taken along line B-B of FIG. 8.

In places where a radial cross section is mentioned, it should be understood that we also mean to encompasses non-circular geometries. A radial section B-B of FIG. 8 is shown in FIG. 9B. This section is taken normal to the inner edge of the surround suspension element. For a surround with a circular geometry, this section will also coincide with a radial direction. A similar section for a surround with a non-circular geometry is understood to be taken normal to the inner edge, but in this case the section may no longer correspond to a radius. For ease of description, we understand the term radial section to mean a section taken normal to the inner edge of the suspension element, and to encompass cases of both circular and non-circular suspension element geometries.

Figure 13:
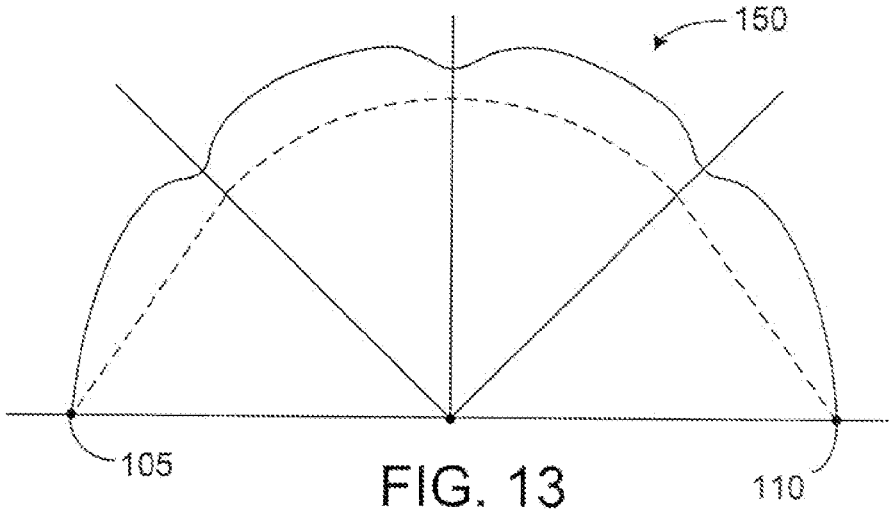
FIG. 13 is a radial cross section of an alternative loudspeaker surround suspension element embodiment.

In a radial cross section, nominal shapes other than half-circular (i.e. a typical half roll) are also contemplated. For example, some embodiments may have radial cross sections comprised of concatenated sections of circular arcs, as would be typical of multi-roll surrounds or spiders, or have undulations along nominally circular arcs or arc sections, as shown in the example of FIG. 13. Another cross section (not shown) may look like a typical half roll, but with the side walls deepended to increase the effective roll height. These radial profiles can be used in toroidal shaped surrounds as depicted in FIGS. 6A-6C, or other less axially symmetrical shapes (e.g. elliptical, oval or racetrack, or other non-circular shapes).

The surround 100 of FIG. 6A includes a series of grooves 125 generally extending from the inner circumferential edge 105 to the outer circumferential edge 110, at an angle to the radial direction, or more generally, at an angle to the normal of the inner edge of the surround suspension element, at the point of the groove closest to the inner circumferential edge. Note that the grooves need not extend over the entire span from inner circumferential edge to outer circumferential edge. The grooves (together with the non-grooved portions between the grooves) can form an undulating (e.g., continuously undulating) surface on the surround along the circumferential direction. Note that the grooves shown in plan view in FIG. 6A, and in some subsequent figures, are depicted as straight lines having no width. This is for convenience in depicting the orientation and location of the grooves. The lines shown depict the location of the lowest point (the bottom) along the grooves. The profile through the grooves is more fully described elsewhere.

Figure 7A:
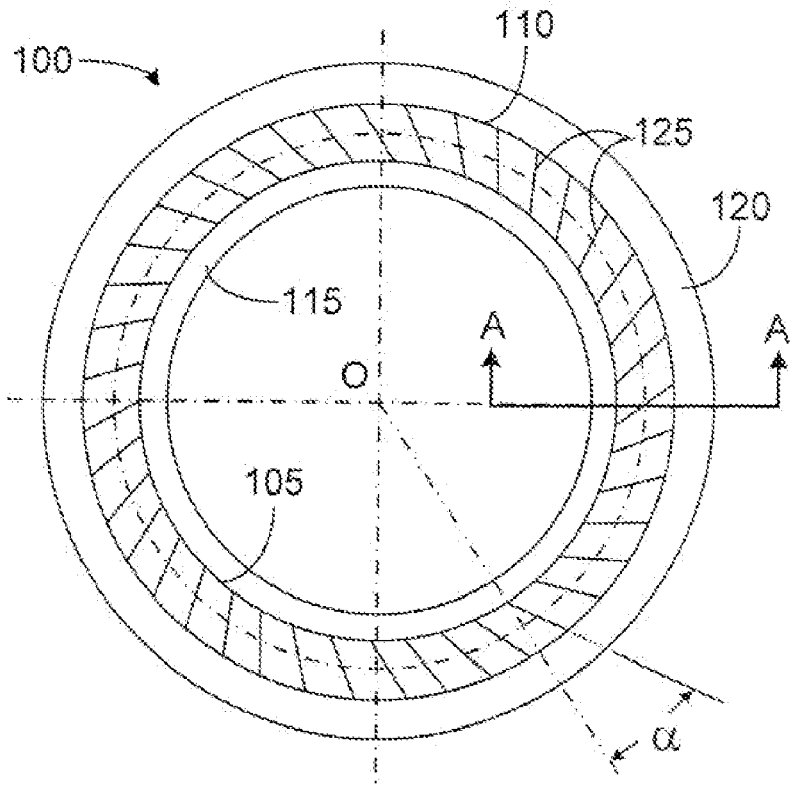
FIG. 7A is a plan view of a loudspeaker surround suspension element.
Figure 7B:
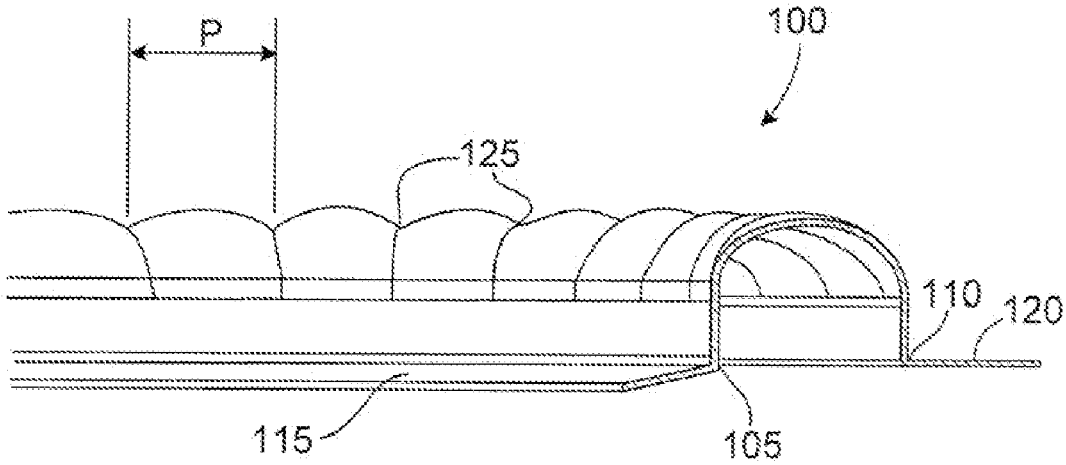
FIG. 7B is a perspective cross-sectional view taken along line A-A of FIG. 7A.

Adjacent grooves are separated by a pitch distance P (FIG. 6C). This can be defined as a circumferential distance taken at a specified radial distance from the origin. For convenience, the distance will be defined at the midpoint between the inner and outer edges (circumferential) of the surround. Another alternative surround suspension element embodiment is shown in FIGS. 7A and 7B. Compared with the grooves shown in FIGS. 6A-6C, the surround shown in FIGS. 7A and 7B has fewer grooves 125 and larger pitch distance P. Various embodiments may use arbitrary pitch distances P. In some examples, the pitch distance P is uniform for all of the successive pairs of grooves around the circumference of the surround. In other examples, the pitch distance could vary.

Each groove 125 is oriented at an angle alpha as can be seen in FIGS. 6A, 7A, and 8. Alpha is the angle between the line of the groove and a normal to the inner edge of the surround. Alpha can vary over a wide range in different embodiments. For embodiments where the path of the groove in plan view traverses a substantially straight line from inner circumferential edge to outer circumferential edge, the angle alpha of the groove path is preferably between 30 and 60 degrees (or −30 to −60 degrees), although useful behavior is obtained with an angle between 10 and 80 degrees (or −10 to −80 degrees). Negative angles of alpha refer to grooves that incline in the opposite direction from the radial (or normal) to that shown in FIG. 8. Grooves 125 (groove paths) can be straight in plan view as in FIG. 6A or curved. The radius of curvature along the length of the groove can be infinite (i.e. the groove is a straight line), a finite constant, or smoothly or otherwise varying. For embodiments with constant, smoothly, or otherwise varying groove curvature, alpha can vary between 0 and 90 degrees, where alpha is defined in an analogous manner to the definition given below for angle of orientation of groove sections.

A groove path may comprise a plurality of sections and a plurality of transition regions. The angle of orientation of each section, where angle of orientation is defined as the angle of the section at the point along the section closest to the inner circumferential edge, to a normal to the inner circumferential edge that intersects the closest point, as well as the radius of curvature of the path section, can be chosen arbitrarily and independently. The radius of curvature of the path section can vary over the section. Transition regions can smoothly join the ends of adjacent path sections. For the case where the radius of curvature at the end of one section and the beginning of the section to which it is joined have opposite sign, the transition region will include an inflection point. The number of inflection points in a groove path is arbitrary.

Figure 14:
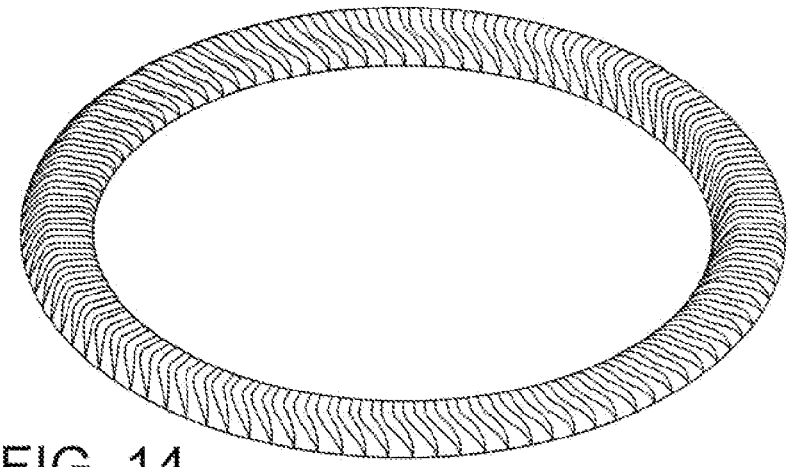
FIG. 14 shows a perspective view of an alternative loudspeaker surround suspension element embodiment.

One embodiment having two transition regions and three sections, with inflection points in each transition region, is shown in FIG. 14. In this embodiment, the angle of orientation of the middle section of the groove path, where the middle section traverses the middle portion of the span W between the inner and outer circumferential edges of the surround suspension element, is smaller than the angles of the first and third sections.

The shape of the surround may be better understood with reference to the profiles taken along sections of FIG. 8. FIG. 9A shows a circumferential profile 140 of an exemplary surround taken along section A-A in FIG. 8. Profile 140 is taken along the midpoint of the span W. Peaks 145 separate adjacent grooves 125 along the profile 140. The radius of curvature of the peak is given by $R_P$ and the radius of curvature of the groove is given by $R_G$. In some examples of the embodiment of FIG. 9A, P=0.178", $R_P$=0.141", $R_G$=0.050", A=0.022", and T=0.010", where "A" is the depth of the groove in FIG. 9A, and "T" is the material thickness of the suspension element, and "P" is the pitch distance between successive peaks (or grooves). It should be noted here that the radius of curvatures for the peak and groove ($R_P$ and $R_G$) are taken to be at the local minima and local maxima of the section shown in FIG. 9A, and for convenience are measured thru the center line of the surround material (note that the radii of curvature could be defined elsewhere, such as along the top or bottom of the material surface as well). The value of $R_G$ given above was obtained at the point along the groove with maximum depth, and the value of $R_P$ given above was obtained at the point where the peak has maximum height. The profile in between the groove and peak is smooth and continuous. One feature of the circumferential profile of some suspension element embodiments is that the profile have continuous curvature over its entire length.

Figure 5:
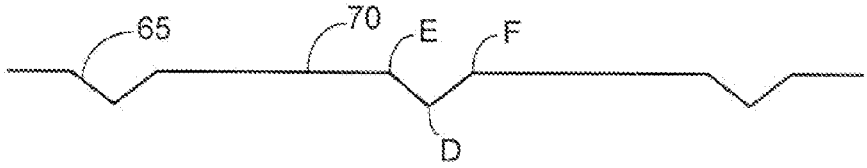
(PRIOR ART) FIG. 5
FIG. 5 is a cross-sectional view taken along line B-B in FIG. 3.

In such examples, the profile should be free of flat areas, such as those present in the profile shown in FIG. 5 of a prior art surround. Continuous curvature is desirable for a circumferential section taken along the midpoint of the span W, as illustrated by profile 140 generated from section A-A in FIG. 8. It is beneficial for the continuous curvature to be present in profiles generated from other sections taken at different radial (or normal) distances from the inner circumferential edge. The property of continuous curvature need not be present for profiles generated from circumferential sections taken over the entire span W, but is usefully present at least for profiles from sections taken close to the midpoint of the span W.

It should be understood that one could emulate the property of continuous curvature using a piecewise linear approximation, comprised of sufficiently small length linear segments. As the length of each linear segment in the approximation decreases, the behavior approaches that of a continuous curve. Such an approximation is contemplated herein. Some portion of the cross-section could be continuously curved while other portions could be piecewise linear.

In some embodiments, $R_P$ is greater than $R_G$. In other embodiments, the profile 140 can be generally approximated by an ordinary cycloid, where Rp is unequal to Rg. In still other examples, the profile 140 is continuously curvilinear and without a constant pitch P between successive peaks.

Figure 9C:
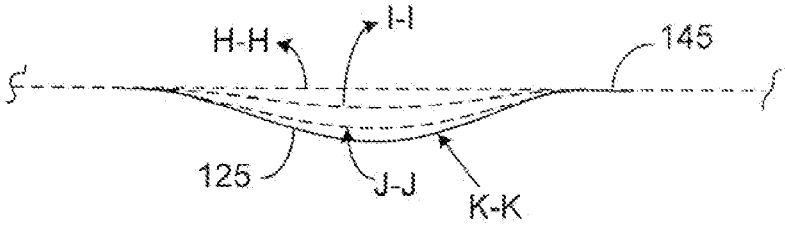
FIG. 9C shows a number of circumferential profiles taken along planes H-H, I-I, J-J, and K-K of FIGS. 8 and 9B.

FIG. 9B shows a profile 150 along line B-B in FIG. 8 extending along the radial direction (or the normal to the inner circumferential edge direction) from the inner to the outer circumferential edges 105, 110 of the surround. Circumferential profiles of one representative groove corresponding to the section lines H-H, I-I, J-J, and K-K of FIGS. 8 and 9B are shown in FIG. 9C. Note that sections H-H, I-I, J-J, and K-K are all taken along the local perpendicular direction, with respect to the outer surface of the surround. The local groove depth is defined as the distance measured along each section, from the outer surround surface, to the bottom of the groove in that section. In some embodiments, the depth of the grooves ranges from a minimum proximate to the inner circumferential edge 105, along section H-H, and progressively increases with radial distance, given by sections I-I, J-J to reach a maximum midway between the inner and outer circumferential edges, given by section K-K, then progressively decreases with increasing radial distance becoming a minimum again proximate to the outer circumferential edge.

Following along the path of the groove from inner to outer circumferential edges, the bottom of the groove generally follows the curvature of the principal surround surface, but typically having a larger radius of curvature. Since the groove can be thought of as an inward projection of the outer surround surface, practically speaking there is no outer surround surface present directly above the bottom of the groove. The curvature that the bottom of the groove generally follows is that of the principal surround surface envelope. In the case of a dome shaped suspension element with grooves, the bottom of the groove would generally follow the curvature of the dome shape envelope (with larger radius of curvature). For a groove bottom that follows the surround suspension element envelope for a dome shaped surround, the radius of curvature will depend on the span W, roll height H, and the desired groove depth. The radius of curvature of the groove bottom path will typically be less than 3 times (for example, two times) the radius of curvature of the surround suspension element envelope. In some cases, it could be less than about 5 times (or even ten times) the radius of curvature of the surround suspension element envelope.

In other embodiments, the depth of the groove may vary as a function of distance along the groove path in other ways. For example, in some embodiments the groove depth may remain constant over a large percentage of the span W of the surround (i.e. the distance between the inner and outer circumferential edges). In other embodiments, the groove depth may have a plurality of local maxima and minima along the groove path, forming undulations in the bottom of the groove.

Figure 10A:
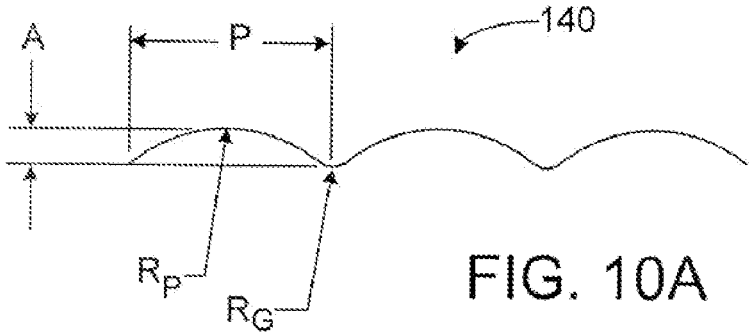
FIGS. 10A-10C are circumferential profiles of various alternative loudspeaker surround embodiments taken along line A-A of FIG. 8.
Figure 10B:
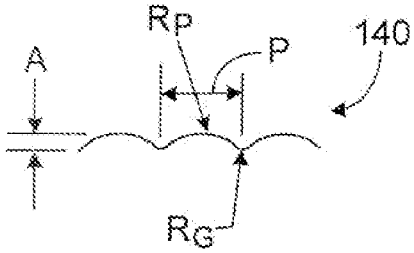
Figure 10C:
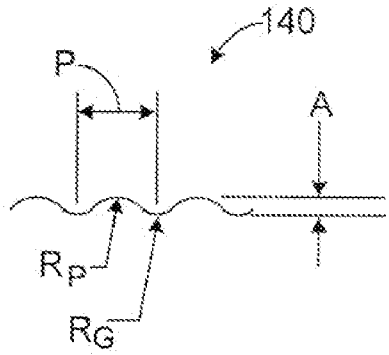

With reference to FIGS, 10A-10C, in some embodiments, the ratio of radius $R_P$ to radius $R_G$, ($R_P/R_G$) of profile 140 is less than about 10. FIG. 10A shows a profile 140 where $R_P/R_G$ is 8.8. In other embodiments, $R_P/R_G$ is less than about 5. In still other embodiments, $R_P/R_G$ is less than about 3. FIG. 10B shows a profile 140 where $R_P/R_G$ is 2.8. FIG. 10C shows a profile 140 where $R_P/R_G$ is about 1.2. Embodiments are also possible where the ratio $R_P/R_G$ is less than one.

In general, both radii $R_P$, $R_G$ should be at least about three times greater than the material thickness T of the surround suspension element, where T is shown in FIG. 9A. This applies for grooves and peaks present in any circumferential section that may be taken around the surround suspension element. Given a surround material thickness T of about 31 mils (0.787 mm) in one embodiment, $R_P$, $R_G$ are greater than about 93 mils (2.36 mm). $R_P$, $R_G$ should also generally be less then infinity (i.e. not flat), with the exception of the piecewise linear approximation mentioned earlier. In general, for practical designs $R_P$, $R_G$ should differ from each other by no more than a factor of 20.

In other examples, the pitch P between successive peaks is at least about 4 times greater than the height A of the peaks (FIG. 9A). In some examples, the height A is between about 0.025 inch (0.064 cm) and 0.10 inch (0.25 cm) and the pitch P is between about 0.15 inch (0.38 cm) and about 0.6 inch (1.52 cm).

Figure 11A:
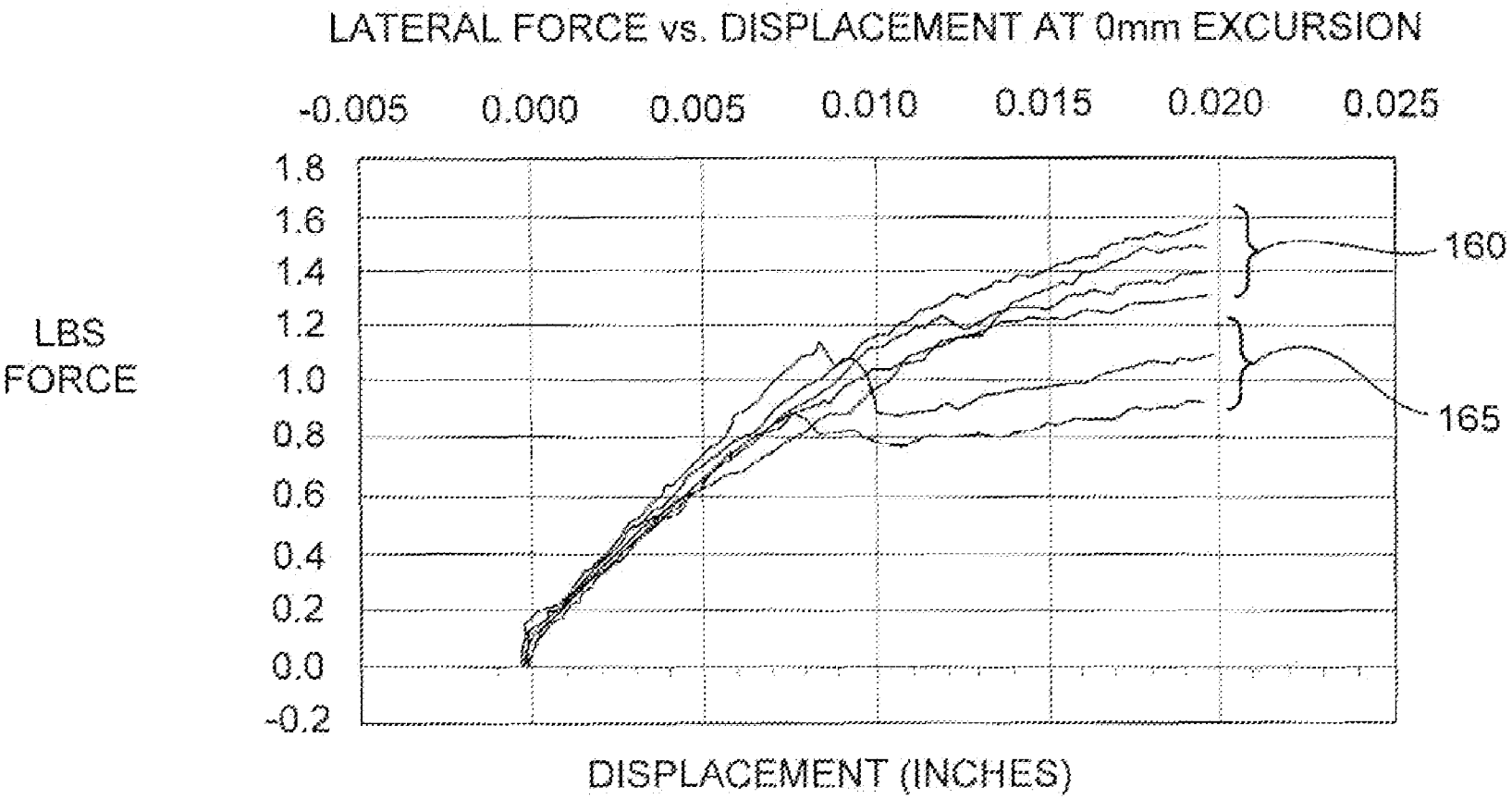
FIG. 11A is a graphical depiction of lateral force versus displacement of various loudspeaker surround suspension elements.

FIG. 11A shows graphical relationships between lateral force applied to a surround and the lateral displacement of the surround, for various surround suspension elements. Lateral force is any force applied to the suspension element orthogonal to the axial direction, where the axial direction is the primary direction of motion for the cone assembly. Curves 160 in FIG. 11A correspond to the example surround shown in FIGS. 7A and 7B. Curves 165 in FIG. 11A correspond to the prior-art surround without grooves of FIG. 2A. It can be seen that the new surround of FIGS. 7A, B is substantially linear as compared with the prior art surround. Onset of buckling is evidenced by a deviation from a generally linear relationship in the various curves, where the onset of buckling can be seen to cause abrupt discontinuities in their lateral force/displacement curves. For curves 165, it can be seen that there is a significant deviation from linear behavior indicating buckling in the surround, at only approximately 0.008 mm of lateral deflection (for zero axial excursion).

Figure 11B:
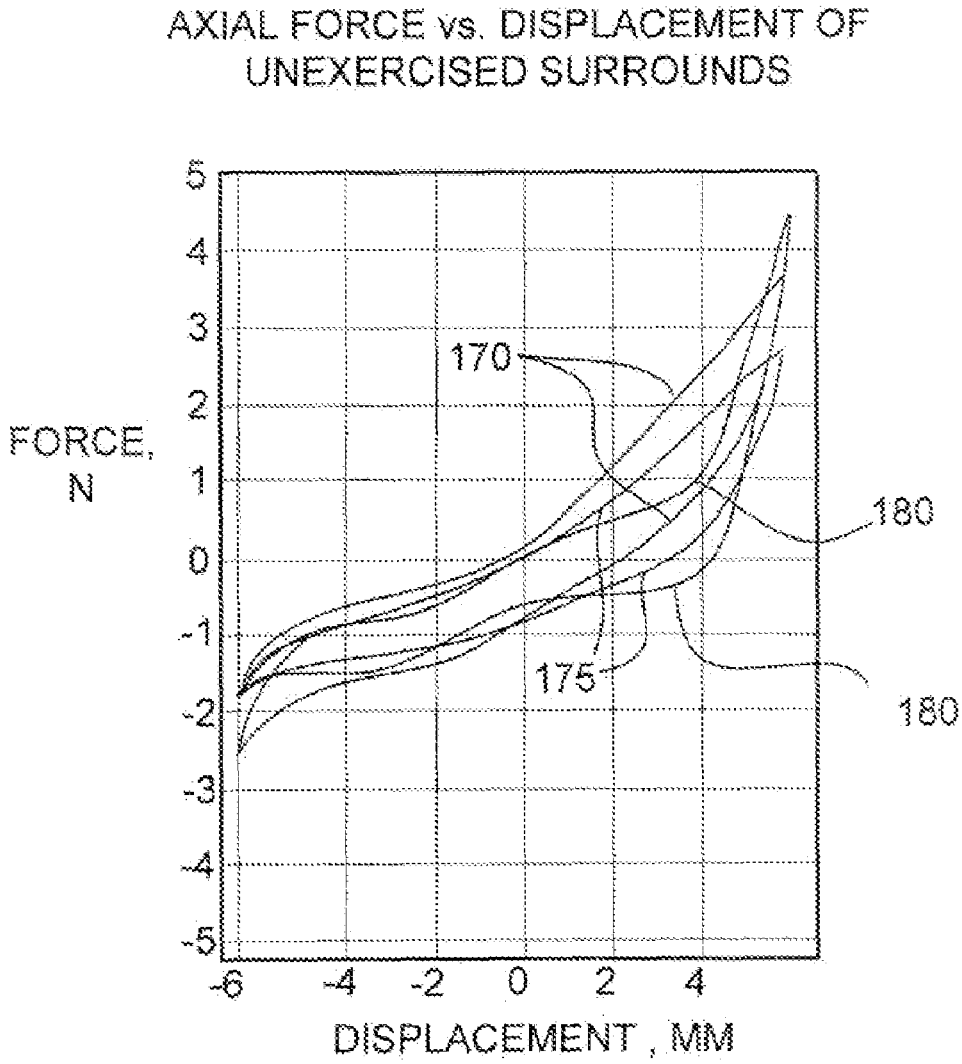
FIG. 11B is a graphical depiction of axial force versus displacement of various unexercised loudspeaker surround suspension elements.
Figure 11C:
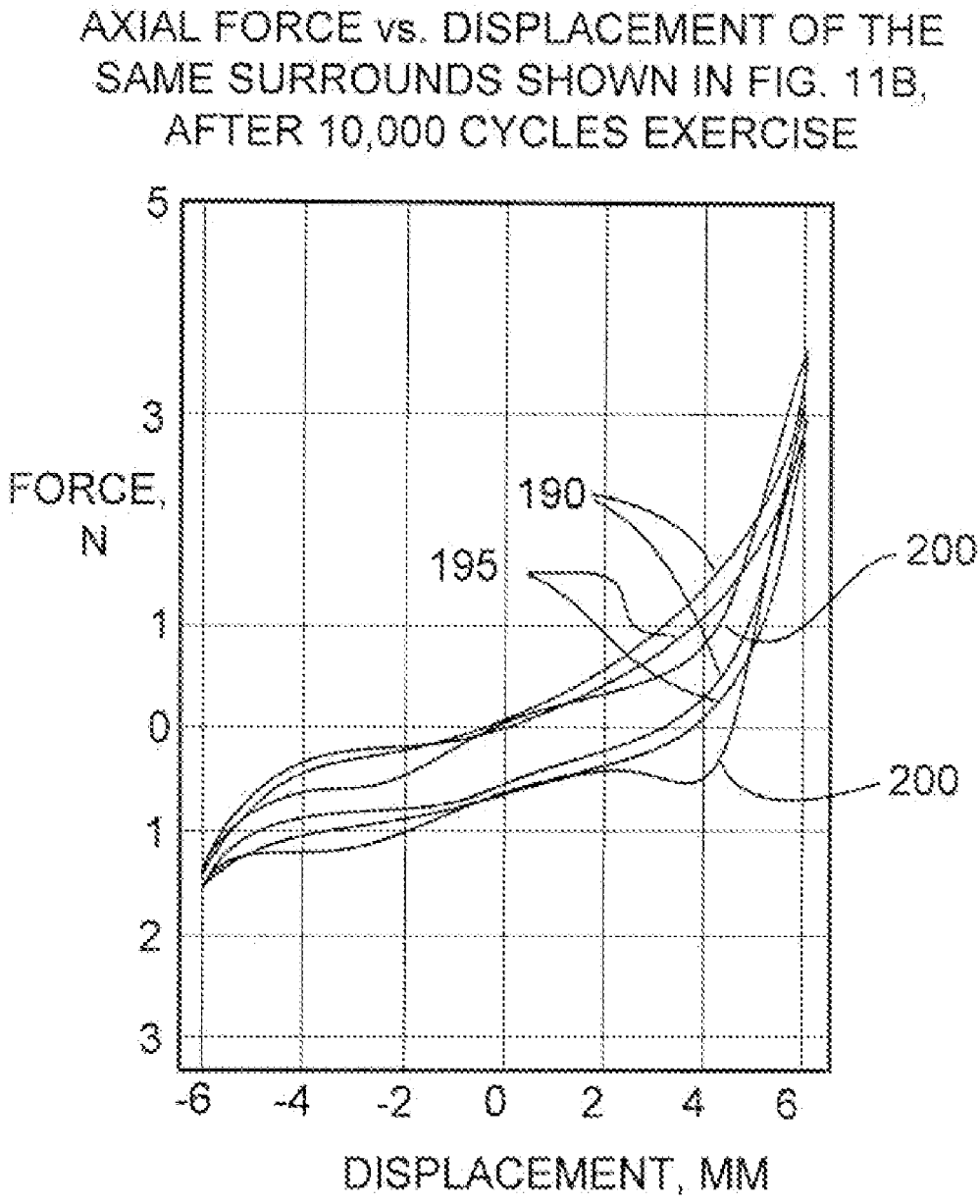
FIG. 11C is a graphical depiction of axial force versus displacement of various exercised loudspeaker surround suspension elements.

FIGS. 11B and 11C are graphs of axial force vs. axial displacement for an exemplary surround and a prior art surround. FIG. 11B shows the behavior of unexercised surrounds, while FIG. 11C shows the same surrounds after 10,000 cycles of exercise at high excursion.

Figure 1:
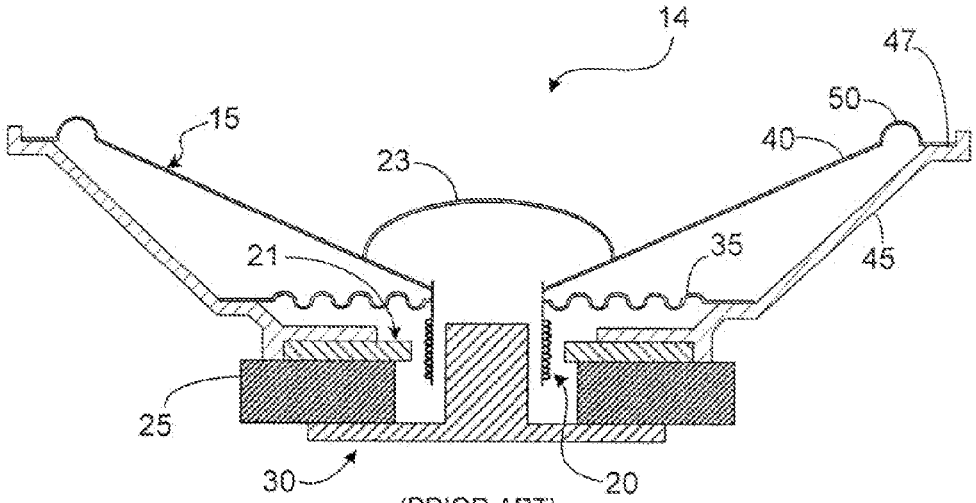
(PRIOR ART) FIG. 1
FIG. 1 is a sectional view of a loudspeaker.
Figure 2A:
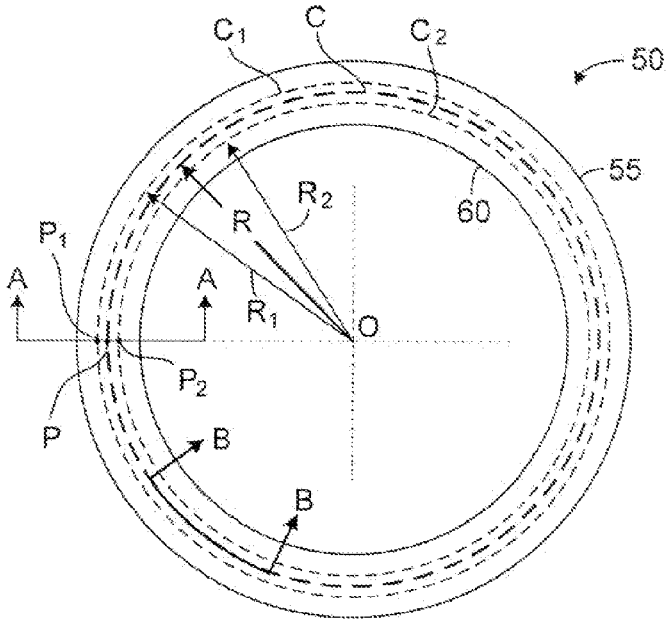
(PRIOR ART) FIG. 2A
FIG. 2A is a schematic plan view of a loudspeaker surround suspension element.
Figure 3:
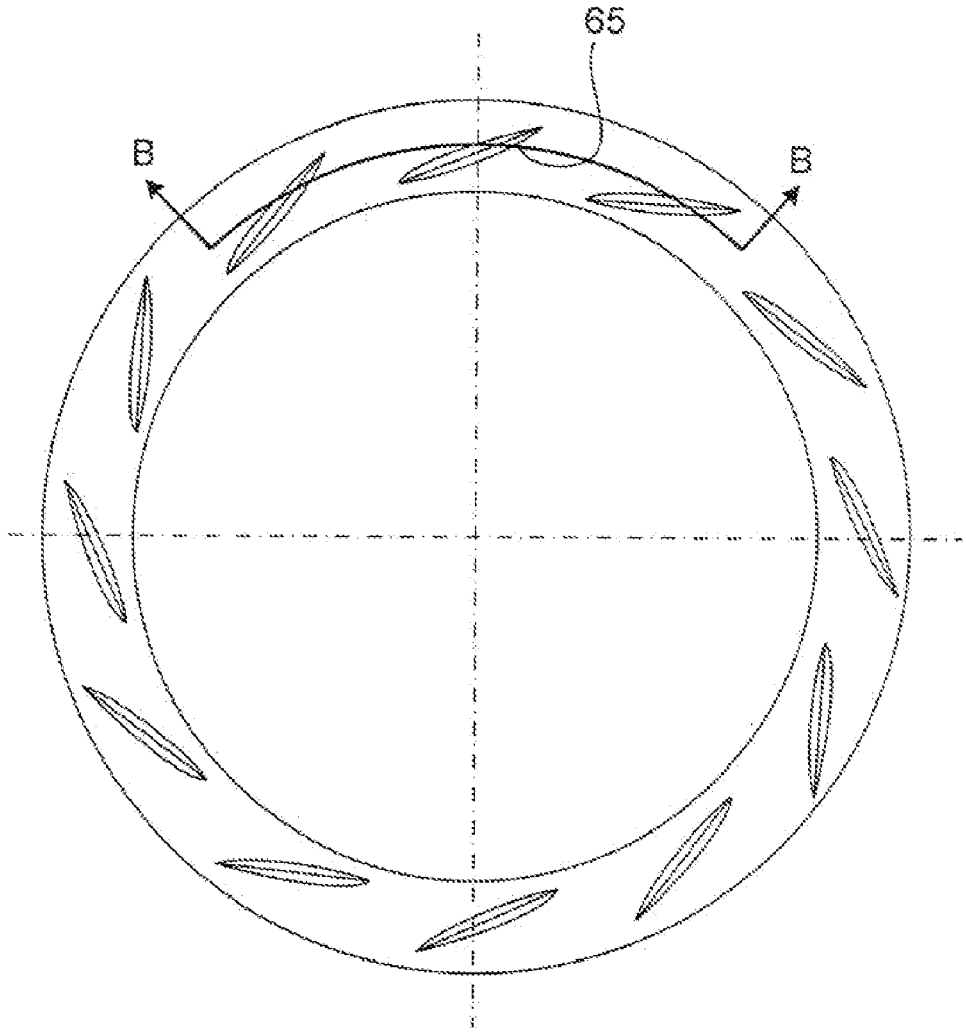
(PRIOR ART) FIG. 3
FIG. 3 is a schematic plan view of an alternative loudspeaker surround suspension element.
Figure 4:
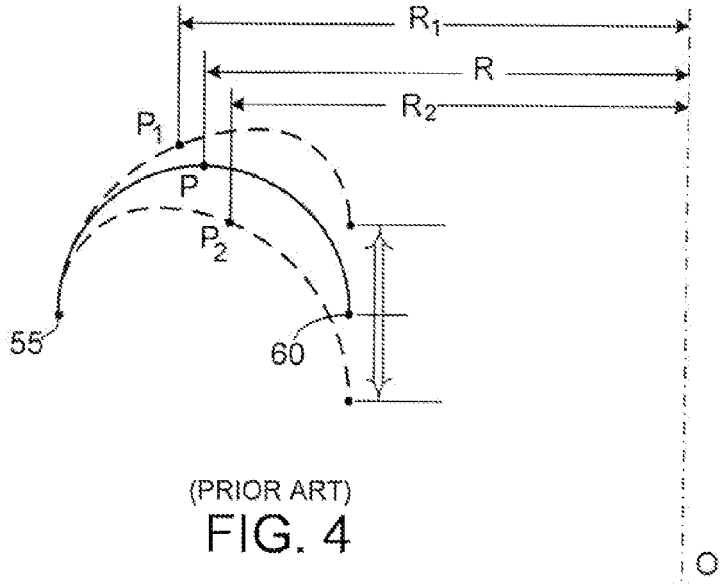
(PRIOR ART) FIG. 4
FIG. 4 is a cross-sectional view taken along line A-A in FIG. 2.

In FIG. 11B, the curves 170 and 175 correspond to the exemplary surround of FIG. 7A and 7B, and curve 180 correspond to the prior-art surround without grooves (as shown in FIG. 2A). In FIG. 11C, curves 190 and 195 correspond to two samples of the exemplary surround of FIG. 7A and 7B, and curve 200 corresponds to the prior-art surround without grooves (as shown in FIG. 2A).

As shown in FIGS. 11B and 11C, the graphical relationship between the axial force applied by the voice coil and the displacement of the exemplary surround is substantially linear as compared with the prior art surround. The onset of buckling is evidenced by a deviation from a generally linear relationship in the various curves. In particular, the downwardly-sagging shape of the curves for 180, 185, 200 and 205, prior to a sharp upward ascendancy at the right-hand side of the graphs, shows significant non-linearity in the axial force/displacement curves of the prior art surround compared to the exemplary surround.

Figure 15:
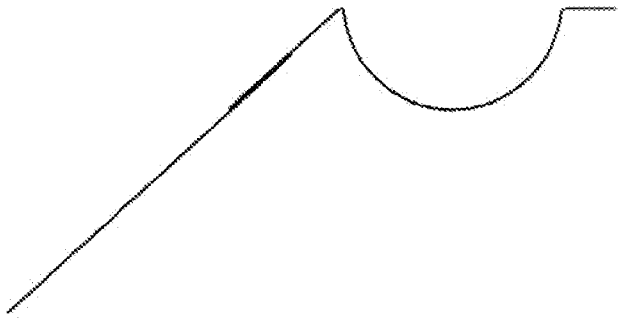
FIG. 15 shows a cross section of a cone/surround assembly using a half roll surround in a "roll down" configuration.

The radial cross section of the suspension elements described herein have been shown using a "roll up" orientation. That is, for suspension elements with a roll shape in radial cross section, the roll extends upward, away from the cone surface. All of the embodiments herein described will also function using a "roll down" orientation. That is, the suspension element (surround or spider) can be flipped over 180 degrees, with provision made for changing mounting flanges to accommodate mounting to the cone and rigid basket. A "roll down" half roll conventional surround suspension element is shown in FIG. 15.

In operation, the surround having a configuration described herein reduces stress concentrations and reduces buckling.

Other embodiments are within the scope of the following claims.

For example, although the surround and the spider are typically distinct components, separate from the cone or diaphragm, one or both may be attached to the cone using adhesives, heat staking, ultrasonic welding, or other joining processes to form an assembly. In some implementations the surround may be formed integrally with a portion of or all of the cone. In the latter cases, the suspension structure has a virtual border even if not a discrete edge.

What is claimed is:

1. Apparatus comprising:

a loudspeaker suspension structure having an inner circumferential border, and an outer circumferential border, and grooves each extending form the inner circumferential border to the outer circumferential border at an angle with respect to a normal to the inner circumferential border, a profile of a circumferential section of the suspension structure have a continuous curvature.

2. The apparatus of claim 1 in which the groove spans only a portion of the distance between the inner circumferential border and the outer circumferential border.

3. The apparatus of claim 1 in which the continuous curvature is cyclical.

4. The apparatus of claim 1 in which the continuous curvature includes a series of peaks and grooves and the radius of curvature of each or the peaks is greater than the radiuses of curvature of the adjacent grooves.

5. The apparatus of claim 1 in which the continuous curvature includes a series of peaks and grooves and the radius of curvature of at least a portion of each of the peaks is less than the radiuses of curvature of the adjacent grooves.

6. The apparatus of claim 4 in which a ratio of the radius of curvature of each of the peaks to the radiuses of curvature of the adjacent grooves is less than 3.

7. The apparatus of claim 4 in which a ratio of the radius of curvature of each of the peaks to the radiuses of curvature of the adjacent grooves is less than 5.

8. The apparatus or claim 4 in which a ratio of the radius of curvature of each of the peaks to the radiuses of curvature of the adjacent grooves is less than 10.

9. The apparatus of claim 4 in which the radius of curvature of at least a portion of each of the peaks is greater than the radiuses of curvature of the adjacent grooves.

10. The apparatus of claim 1 in which the suspension structure comprises a fractional part of a toroid.

11. The apparatus of claim 1 in which the suspension structure conforms to a rolled shape.

12. The apparatus of claim 1 in which the rolled shape is rolled up.

13. The apparatus of claim 1 in which the rolled shape is rolled down.

14. The apparatus of claim 1 in which the rolled shape comprises two or more rolls between the inner circumferential border and the outer circumferential border.

15. The apparatus of claim 1 in which a radius of curvature of each of the grooves is at least about three times a thickness of a material of which the suspension structure is formed.

16. The apparatus of claim 1 in which a radius of curvature of each of the grooves is at least about seven times a thickness of a material of which the suspension structure is formed.

17. The apparatus of claim 1 in which grooves are spaced regularly along a circumference of the suspension structure, each of the grooves has a depth, a pitch of the spacing is at least about four times the depth.

18. The apparatus of claim 1 in which grooves are straight in plan view.

19. The apparatus of claim 18 in which the angle of the grooves is in the range of 10 to 80 degrees.

20. The apparatus of claim 1 in which each of the grooves comprises a curve in plan view.

21. The apparatus of claim 20 in which the angle of the grooves is in the range of 0 to 80 degrees.

22. The apparatus of claim 20 in which the curve begins at an angle to the normal to the inner circumferential border or the outer circumferential border.

23. The apparatus of claim 20 in which the carve comprises sections.

24. The apparatus of claim 23 in which the sections comprise straight sections.

25. The apparatus of claim 23 in which the sections comprise curved sections.

26. The apparatus of claim 23 in which the sections have respectively different angles with respect to the normal to the inner border.

27. The apparatus of claim 23 in which the sections also comprises transition sections that smoothly the straight or curved sections.

28. The apparatus of claim 23 in which the sections meet at inflection points.

29. The apparatus of claim 1 in which each of the grooves has a depth that varies from the inner border to the outer border.

30. The apparatus of claim 29 in which the variation corresponds to the variation in height of a principal contour of the suspension structure.

31. The apparatus of claim 29 in which the groove has a larger radius of curvature than does the principal contour.

32. The apparatus of claim 1 in which each of the grooves has a generally constant depth along most of a path of the groove.

33. The apparatus of claim 29 in which the groove includes two or more local minima or maxima.

34. The apparatus of claim 1 in which a radial cross section of the suspension structure has a configuration of a partial toroid.

35. The apparatus of claim 1 in which a radial cross section of the suspension structure has a configuration other than of a partial toroid.

36. The apparatus of claim 1 in which a radial cross section of the suspension structure has two or more local minima or maxima.

37. The apparatus of claim 1 in which the continuous curvature comprises a piecewise linear contour.

38. The apparatus of claim 1 in which the suspension structure comprises a surround.

39. The apparatus of claim 1 in which the suspension structure comprises a spider.

40. An apparatus comprising:

a loudspeaker suspension structure having an inner border, an outer border and a material thickness;

grooves extending from the inner border to the outer border and separated by a groove pitch, the grooves having a radius of curvature along a circumferential section; and peaks defined between the adjacent grooves and having a peak radius of curvature along the circumferential section, the peak radius being less than about ten times the groove radius.

41. The apparatus of claim 40 in which the peak radius is less than about five times the groove radius.

42. The apparatus of claim 40 in which the peak radius is less than about three times the groove radius.

43. The apparatus of claim 40 in which the grooves are curved in plan view.

44. The apparatus of claim 33 in which grooves are straight in view.

* * * * *

UNITED STATES PATENT AND TRADEMARK OFFICE

CERTIFICATE OF CORRECTION

PATENT NO. : 7,397,927 B2
APPLICATION NO. : 10/993996
DATED : July 8, 2008
INVENTOR(S) : Mark A. Pircaro It is certified that error appears in the above-identified patent and that said Letters Patent is hereby corrected as shown below:

In claim 1, line 4, replace “form” with -- from --;

In claim 4, line 2, delete “or”;

In claim 12, line 1, replace “1” with -- 11 --;

In claim 13, line 1, replace “1” with -- 11 --;

In claim 14, line 1, replace “1” with -- 11 --;

In claim 17, line 2, after “depth” add -- and --;

In claim 18, line 1, after “which” add -- the --;

In claim 23, line 1, replace “carve” with -- curve --.

Signed and Sealed this

Twenty-fourth Day of March, 2009

John Doll

JOHN DOLL
*Acting Director of the United States Patent and Trademark Office*

UNITED STATES PATENT AND TRADEMARK OFFICE

CERTIFICATE OF CORRECTION

PATENT NO. : 7,397,927 B2
APPLICATION NO. : 10/993996
DATED : July 8, 2008
INVENTOR(S) : Mark A. Pircaro It is certified that error appears in the above-identified patent and that said Letters Patent is hereby corrected as shown below:

Column 8, In claim 1, line 65, replace “form” with -- from --;

Column 9, In claim 4, line 9, delete “or”;

Column 9, In claim 12, line 32, replace “1” with -- 11 --;

Column 9, In claim 13, line 34, replace “1” with -- 11 --;

Column 9, In claim 14, line 36, replace “1” with -- 11 --;

Column 9, In claim 17, line 46, after “depth” add -- and --;

Column 9, In claim 18, line 49, after “which” add -- the --;

Column 9, In claim 23, line 60, replace “carve” with -- curve --.

This certificate supersedes the Certificate of Correction issued March 24, 2009.

Signed and Sealed this

Fourteenth Day of April, 2009

John Doll

JOHN DOLL
*Acting Director of the United States Patent and Trademark Office*